United States Patent [19]

von der Wettern et al.

[11] 4,381,357

[45] Apr. 26, 1983

[54] COVERING, A PROCESS OF PRODUCING IT AND THE USE THEREOF

[75] Inventors: Walter von der Wettern, Bergisch-Gladbach-Sand; Harald Albrecht, Cologne, both of Fed. Rep. of Germany

[73] Assignee: Gebr. von der Wettern GmbH, Koln-Deutz, Fed. Rep. of Germany

[21] Appl. No.: 304,185

[22] Filed: Sep. 21, 1981

[30] Foreign Application Priority Data

Oct. 3, 1980 [DE] Fed. Rep. of Germany ..... 3037390

[51] Int. Cl.[3] ..... C08L 95/00

[52] U.S. Cl. ..... 524/68; 260/758; 524/71

[58] Field of Search ..... 260/38.5 AS, 758; 524/68, 71

[56] References Cited

U.S. PATENT DOCUMENTS 4,196,115 4/1980 Bresson ..... 260/28.5 AS
4,217,259 8/1980 Bresson ..... 260/28.5 AS
4,282,127 8/1981 Desgouilles ..... 260/28.5 AS

FOREIGN PATENT DOCUMENTS 1440 4/1979 European Pat. Off. .
1754 5/1979 European Pat. Off. .

OTHER PUBLICATIONS

Glossary of Terms Relating to Rubber and Rubber--Like Materials, ASTM No. 184, p. 85.

*Primary Examiner*—Melvyn I. Marquis
*Attorney, Agent, or Firm*—Merriam, Marshall & Bicknell

[57] ABSTRACT

A covering especially for roads consisting of mineral fillers, reclaimed rubber and a binder based on bitumen, it being possible to incorporate 5 to 30% by weight of reclaimed rubber and the binder comprising a hot-homogenized blend of bitumen and thermoplastic polymers, especially of the radial teleblock copolymer type being used. The resultant coverings are capable of reducing the annoyance caused by rolling noises etc. without the necessity of putting up with losses of other qualities.

12 Claims, No Drawings

COVERING, A PROCESS OF PRODUCING IT AND THE USE THEREOF

This invention relates to a novel covering, especially a roadway covering, which consists of mineral fillers, reclaimed rubber and a binder based on bitumen. Moreover, the invention relates to a process for the production of this covering and its use for sound insulation, especially of roadways.

Within the scope of combating environmental stress and strain, the control of noise, especially traffic noise, plays an important part. The construction of noise guard walls and noise guard dams at the border of roads having dense traffic near dwelling places belongs to these measures. However, it would be less expensive and more advantageous to reduce already the generation of noise by the traffic. Even if the motor and driving wind noises of motor vehicles are substantially reduced, there is still left a considerable noise annoyance by the rolling noise. Therefore, it is an object of the present invention to provide a roadway covering which reduces the generation of rolling noise and reflects the remaining driving noise to a small extent and absorbs it to a substantial extent. It could be expected that roadway coverings made of elastic asphalt with a substantial proportion of elastomeric materials might be suitable to achieve the combating of noise at the source. However, such a noise-reducing covering layer must meet all requirements of the traffic load and the other conditions.

Old rubber tires are known to be a further environmental pollution. Therefore, part of the used-up tires is processed to form granular or fibrous reclaimed rubber and partially reused in manufacturing tires. Experiments to incorporate such reclaimed rubber in asphalt coverings have also been described in many cases, but there is no case up to the present time where amounts greater than 3 to 5% of these reclaimed rubbers have been successfully incorporated in these coverings without deteriorating the mechanical properties of the roadway coverings in an intolerable manner.

Therefore, it is another object of the present invention to incorporate reclaimed rubber in a proportion greater than 5% in roadway coverings without reducing thereby the quality of these roadway coverings. It is known from DE-OS 21 19 178 to admix rubber vulcanisate particles to the filler material and binder after heating to adhere to the heated aggregate particles due to a partial chemical change or decomposition. However, this addition of only a total of 3% by weight of fibrous and pulverulent reclaimed rubber results in deteriorated properties of the roadway coverings. While it is alleged now as before that it has been found to be advantageous to subject the filamentious rubber material to a pretreatment with a material to increase the adhesiveness, there is no disclosure which materials might be suitable for this purpose. It is known from DE-OS 21 46 902 to admix polypropylene to the bitumen or asphalt, which is said to improve the adhesive properties, tenacity property and breaking or crushing strength of the covering. The proportion of polypropylene is said to be 1 to 8 and preferably 3 to 6% by weight. Mixing of polypropylene with the bitumen is extremely difficult and, therefore, requires an expensive special apparatus. Therefore, this process did not gain importance in practice.

DE-OS 22 53 495 describes a process for producing a covering layer wherein a mixture of stone chips and bituminous binder is applied to the foundation and this supporting structure is then strengthened or compacted by a mortar which penetrates into the cavities and voids and in which stiffening fillers or elastomers are added to the bituminous binder. The elastomers which may be used include rubber, vinyl polymers and the like. These compositions are particularly useful for sealing coverings but do not accomplish the objects mentioned above, i.e. to utilize great amounts of reclaimed rubber and have a sound-absorbing action.

A process for the production of a material consisting of mineral, polymeric and bituminous constituents where the polymeric constituents may be comminuted thermoplastic polymers from various sources has become known from DE-AS 24 18 977. Since the polymers are thermoplastic, processing is relatively easy. However, only as little as 60 to 100% of bitumen, based on the weight of the polymeric constituents, is allowed to be added to this composition. Reclaimed rubber cannot be processed in this case. Due to the relatively expensive starting materials, this process can be used only to a limited extent and for special purposes.

In an article in GAK 1977, pp. 842 to 847, R. Delmé proposed the modification of bitumen with radial teleblock elastomers. However, he indicates to the fact that only a few types of bitumen appear to be suitable. He further describes that, in the laboratory, these teleblock copolymers could be mixed by means of a propeller agitator at 180° C. within three to five hours with the bitumen. On a large scale, mixing is intended to be effected in horizontal signal-type kneaders of the kind which is usual in processing bitumen. The mixing process should be carried out on principle at 180° C. because degradation of the polymers occurs at higher temperatures. Mixing apparatus with high shear forces are to be used for shorter mixing cycles. Oxidized bitumen is not compatible with thermoplastic styrene-butadiene rubbers so that only a few oxidized bitumen types can be modified satisfactorily with the teleblock copolymers. While Delme recommends the modification of bitumen with radial teleblock elastomers for various fields of application, e.g. bitumen-felt panels, joint fillers, muffling of noises and underseal in automobile industry as well as pipe lines and buried cables, he represents as disappointing the always repeated attempts to modify road bitumen by additions of rubber. Up to the present time, the difficulties and increased costs of mixing bitumen with rubbers have not been justified by a corresponding improvement in quality.

It has now been found surprisingly that a binder based on bitumen which contains 5 to 25% of a thermoplastic polymer, desirably a radial teleblock copolymers which must have been homogenized hot with the bitumen is capable of holding 5 to 30% of reclaimed rubber in addition to mineral fillers and results in coverings, especially roadway coverings, which meet all quality demands. It has additionally been found that these coverings are capable of supporting the combating of noise at the source by reducing the rolling noises and, moreover, that less of the motor and driving wind noise is reflected and is rather absorbed.

Especially copolymers of butadiene and styrene in a ratio of 75/25 to 60/40 having a molecular weight of 50,000 to 600,000 have been found to be particularly useful als radial teleblock copolymers.

Suitable bitumens include especially all distilled standard bitumens of classes B 25 to B 200. These bitumen qualities are compatible with the radial teleblock copolymers and can be homogenized at temperatures of 180° to 220° C. and preferably 180° to 200° C. within 0.3 to 2 hours in a high speed mixer. The reclaimed rubber and mineral substances can be admixed in usual manner with these polymer-modified binders, it having been found to be advantageous to preheat the mineral substances and add the reclaimed rubber at room temperature. The resultant mixtures are further processed in known manner to form the covering. To be able to homogenize hot the bitumen and the radial teleblock copolymers, high speed mixers are necessary, and especially rotor-stator systems have been found to be useful.

Due to their satisfactory properties, the new coverings are especially useful as roadway coverings which are expected to have a high sound absorption. Due to their good mechanical properties, they may also be used for bridge plates of all-steel construction (orthotropic plates) as being described, for example, in DE-OS 23 04 004. Moreover, these coverings may be used for schoolyards, runways of airports, etc. because it has been found that the compatible components, i.e. bitumen and radial teleblock copolymers having been homogenized hot in accordance with the invention, are capable of taking up and bind various kinds of mineral fillers and various amounts of reclaimed rubber. Thus, it is dependent upon the particular intended use which bitumen quality is modified with the radial teleblock copolymers and then mixed with the desired amount of reclaimed rubber and mineral substances and processed to form a covering.

It is a great advantage of the process according to the invention that the uneconomically long mixing periods in the temperature range of 180° to 220° C. can be kept relatively short, i.e. 0.3 to 2 hours and preferably 0.8 to 1.5 hours. Longer mixing periods are not only uneconomical but change the bitumen and the copolymer detrimentally. The bitumen hardens and the copolymers are changed detrimentally by chain breakage.

The process according to the invention may be carried out both batchwise and continuously. If desired, the mixing period may be further reduced by connecting a plurality of rotor-stator system mixers in series. It is decisive that adequate homogenization takes place.

The invention is illustrated in greater detail in the examples which follow. The surprisingly excellent properties of the coverings according to the invention as compared with conventional products and production processes are obvious from the comparative experiments.

EXAMPLE 1

In a combination of apparatus comprising a usual bitumen pump and a rotor-stator system mixer, 3 metric tons of polymer-modified bitumen are prepared by homogenizing 2.55 metric tons of bitumen B 200 and 0.45 metric tons of a radial teleblock copolymer (butadiene/styrene ratio, 70/30; trade name "Solprene 411", produced by Phillips Petroleum Company, U.S.A.; molecular weight, 300,000) for 60 minutes at 190° C. The motor output was 7.5 kw at 3,000 r.p.m. A sample of this binder is examined and gives the following properties:

(a) In line with DIN standard 53504 and ASTM D 412, Die A type, the tensile stress F max up to 300% elongation is measured and gives 1.9 N. The permanent set at elongation after 24 hours is 12%.

(b) According to DIN 1995, the softening point (RuK) is 110° C. and the Fraass breaking point is −43° C.

(c) The flow length after 24 hours at 80° C. is 8 mm.

EXAMPLE 2

In an analogous manner as described in Example 1, 3 metric tons of polymer-modified bitumen are prepared from 2.7 metric tons of bitumen B 80 and 0.3 metric tons of radial teleblock copolymer (Solprene 411). The mixing temperature is 200° C. and the mixing period 1 hour. The tested properties of a sample were a tensile stress or force F max up to 300% elongation of 3.67 N, a permanent set at elongation after 24 hours of 10%, a softening point (RuK) of 99° C., a Fraass breaking point of −39° C. and a flow length after 24 hours at 80° C. of 11 mm.

EXAMPLE 3

In an analogous manner as described in Example 1, a polymer-modified binder is produced from 90% bitumen B 45 and 10% of radial teleblock copolymer (Solprene 411). The mixing temperature for 1 hour is 200° C. The tested properties are as follows:

| | |
|---|---|
| Tensile stress or force F max up to 300% elongation: | 0.1 N |
| Permanent set at elongation after 24 hours: | 12% |
| Softening point (RuK): | 98° C. |
| Fraass breaking point: | −30° C. |
| Flow length after 24 hours at 80° C. | 6 mm |

Examinations under the microscope of the final samples and samples having been taken previously or subsequently showed that extensive homogenization has occurred after as little as 30 minutes, this homogenization increasing only slightly during the course of the following 30 minutes and remaining then substantially constant. Satisfactory homogenization is indicated by the formation of a crosslinked structure in which the bitumen particles are uniformly surrounded by the copolymers. These homogenized binders produced on a commercial scale are absolutely equivalent to the best homogenized blends produced on a laboratory scale.

EXAMPLE 4

In an analogous manner as described in Example 3, quantities of 3 metric tons each of binder are produced from 90% of bitumen B 200, or bitumen B 80, respectively, and 5% of each of the radial teleblock copolymers (Solprene 411 and Solprene 1205; butadiene/styrene ratio, 75/25; molecular weight, 140,000). The blending temperature was 190° C. and 200° C., respectively, and the blending period was 1 hour in each case. The homogenization was complete after 1 hour in both cases. The remaining measured values were 94° and 99° C., respectively, for the softening point, −35° C. and −38° C., respectively, for the Fraass breaking point, 1.25 and 3.67 N, respectively, for F max and 18 and 10 mm, respectively, for the permanent set at elongation after 24 hours.

Recipes having the following compositions were prepared from these two binders:

| Recipe (a) (B 200) | |
|---|---|
| Polymer-modified binder | 20% by weight |
| Broken stone 2/5 mm. | 35% by weight |

-continued

| | |
|---|---|
| Broken stone ‖ mm. | 25% by weight |
| Reclaimed rubber 1/5 mm. | 10% by weight |
| Sand | 10% by weight |
| Recipe (b) (B 200) | |
| Polymer-modified binder | 20% by weight |
| Broken stone 2/5 mm. | 35% by weight |
| Broken stone ‖ mm. | 25% by weight |
| Reclaimed rubber 1/5 mm. | 20% by weight |
| Recipe (c) (B 80) | |
| Polymer-modified binder | 12% by weight |
| Broken stone 2/5 mm. | 25% by weight |
| Broken stone ‖ mm. | 43% by weight |
| Reclaimed rubber ‖ mm. | 20% by weight |
| Recipe (d) (B 80) | |
| Polymer-modified binder | 10% by weight |
| Broken stone 2/5 mm. | 22% by weight |
| Broken stone ‖ mm. | 43% by weight |
| Reclaimed rubber ‖ mm. | 20% by weight |

These blends were mixed at about 200° C. in a large-scale asphalt blending unit with the binder temperature being 175°-200° C., the aggregate temperature being 220°-240° C., the temperature of the blended material being 180°-200° C., while the reclaimed rubber was added at ambient temperature (about 18° C.).

At the feed line to the binder balance was installed an apparatus which permitted direct pumping of the binder into the weighing machine. Moreover, the elevator to the feed opening was arranged in such a manner that it permitted addition of the reclaimed rubber to the binder-mineral blend through a separate weighing machine. The finished blends were partialy cast to form measuring plates having a size of 50×50×4 cm. and, while being loaded with a wooden plate, compacted by means of a vibrating roller, and partially they were applied by means of a road-making machine to incorporate a covering on a road surface area of about 40 m. in length and about 3.75 m. in width, these road surface areas having previously been milled out to a depth of 4 cm. A VAT pressure-sensitive adhesive S was sprayed onto the milled-out surface in an amount of about 1 kg./sq.m., and then the asphalt was applied by means of the road-making machine (ABG-Titan 350 S).

EXAMPLE 5

In an analogous manner as described in Example 4, a blend of 20% of polymer-modified binder (bitumen B 80) was mixed with 35% by weight of broken stone 2/5 mm. and 25% by weight of broken stone 5/8 mm. as well as 20% by weight of reclaimed rubber 5/8 mm. The binder temperature was 200° C., the aggregate temperature 240° C., the temperature of the blended material 190°-200° C. and the temperature of the reclaimed rubber (atmospheric temperature) about 25° C. A pressure-sensitive polyurethane adhesive (Kleiberit R 217.1) was used as adhesive to bond the covering to the foundation. Application with the road-making machine was effected with full vibration of the board. A cross-section measurement, a measurement of the skid resisting properties by means of a pendulum apparatus and comparative sound measurements were effected on this covering. Installation defects at the surface could be eliminated only at a temperature above about 170° C. because the elastic asphalt is here no longer processible due to the high viscosity of the binder. However, unevenness of this kind in the covering can be corrected by means of electrically heated steel plates.

Further samples were prepared with other bitumen-based adhesives, viz. Fina adhesive bridge emulsion, Tego adhesive bridge emulsion, Tego-Promak pressure-sensitive adhesive E and Tego-Promak pressure-sensitive adhesive F. The best results were obtained with the polyurethane adhesive Kleiberit R pressure-sensitive adhesive 217.1.

The cross section measurement on the test covering of a road having dense traffic showed that, within 30 days at two different points, the difference was not more than 0.1 to 0.3 mm. Measurement of the non-skid property with the pendulum apparatus was made in accordance with the "Arbeitsanweisung für kombinierte Griffigkeits- und Rauhigkeitsmessung mit dem Pendelgerät und dem Ausfluβmesser", Forschungsgesellschaft fuer Strassenwesen, edition 1972. The results were substantially better than the values of a comparable asphalt concrete 0/8.

Comparative sound measurements on the covering according to the invention as compared with conventional coverings had the result that the covering according to the invention reduces the frequencies above 800 c.p.s. to a considerable extent not only by lower rolling noises at various speeds but also by absorption of the sound resulting from the other driving noises and motor noises. The reduction in noises depending upon the speed (50 to 90 km./hr.) and the starting and switching-off of the motor during the measurement was $\Delta L = 1$ to 10 dB(A), especially in the high frequency range from 1,000 to 6,000 c.p.s.

Comparative test 1

Test blend with reclaimed rubber and standard bitumen:

Own experiments with reclaimed rubber proportions of 3 to 5% in bituminous asphalt blends had the result that this substantially does not change the rolling noises caused by the vehicles. Higher percentages of reclaimed rubber resulted in poor processibility and very poor bonding-in of the solids. This result was found with various quantities, various temperatures, various types of bitumen and various particle sizes of the mineral additives.

Comparative test 2

Test blend with reclaimed rubber, standard bitumen and additives of various polymeric materials:

Asphalt blend and addition of "Pulvatex" (natural rubber) to standard bitumen resulted without reclaimed rubber in improved mechanical properties as compared with conventional asphalt blends, but this does not result in improved bonding-in of reclaimed rubber. While corresponding tests with the addition of "Cariphalt" (bitumen-rubber blend) to standard bitumen resulted in an improved recovery or resilience behavior, an increased amount of added reclaimed rubber resulted in a substantial increase in abrasion and deterioration of the bonding-in of the reclaimed rubber.

Corresponding tests with "Baypren" (synthetic rubber) to standard bitumen also resulted in products having largely deteriorated abrasion properties.

Asphalt blends having added thereto variable amounts of "SBR latex" also did not show an improvement of abrasion values as compared with other additives. Tests with the adhesive "coumarone-indene resin" which, as stated by the producer, has a high temperature resistance and resistance to thermal shocks resulted in a relatively high increase in softening point (RuK). This additive also increases the cracking tensile strength of test samples consisting of asphalt blends, but only with very low amounts of added reclaimed rubber. Thus, elastic roadway coverings reducing the rolling noises and being simultaneously strong and stable cannot be produced with these products.

What is claimed is:

1. A road covering comprising a mixture of mineral fillers, 5 to 30% by weight of small particles of reclaimed rubber and a binder comprising a ratio of 95-75 parts by weight of bitumen homogenized hot with 5-25 parts by weight of a thermoplastic polymer.

2. A road covering according to claim 1 in which the thermoplastic polymer is a radial teleblock copolymer.

3. A road covering according to claim 1 or 2 in which the rubber comprises ground tires.

4. A road covering according to claim 1 in which the thermoplastic polymer is a butadiene-styrene copolymer.

5. A road covering according to claim 1 in which the thermoplastic polymer is a radial teleblock copolymer of butadiene and styrene in a ratio of 75/25 to 60/40 parts by weight having a molecular weight of 50,000 to 600,000.

6. A process comprising homogenizing a ratio of 95-75 parts by weight of bitumen with 5-25 parts by weight of a thermoplastic polymer at a temperature of 180° to 220° C. in about 0.3 to 2 hours in a high speed mixer to produce a hot binder; and mixing the hot binder with small particles of reclaimed rubber and a mineral filler to produce a road covering.

7. A process according to claim 6 in which the thermoplastic polymer is a radial teleblock copolymer.

8. A process according to claim 6 or 7 in which the rubber comprises ground tires.

9. A process according to claim 6 in which the thermoplastic polymer is a butadiene-styrene copolymer.

10. A process according to claim 6 in which the thermoplastic polymer is a radial teleblock copolymer of butadiene and styrene in a ratio of 75/25 to 60/40 parts by weight having a molecular weight of 50,000 to 600,000.

11. A process according to claim 6 or 7 in which a high speed mixer means is used to homogenize the bitumen and the thermoplastic polymer.

12. A process according to claim 11 in which the high speed mixer means comprises a combination of a bitumen pump and mixer with a rotor-stator system.

* * * * *